US008600268B2

(12) United States Patent
Kunihiro

(10) Patent No.: US 8,600,268 B2
(45) Date of Patent: Dec. 3, 2013

(54) DEVELOPING DEVICE AND IMAGE FORMING APPARATUS

(75) Inventor: Hisashi Kunihiro, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 219 days.

(21) Appl. No.: 13/176,125

(22) Filed: Jul. 5, 2011

(65) Prior Publication Data

US 2012/0008988 A1 Jan. 12, 2012

(30) Foreign Application Priority Data

Jul. 7, 2010 (JP) ..... 2010-155079

(51) Int. Cl.
*G03G 15/08* (2006.01)

(52) U.S. Cl.
USPC ..... 399/254; 399/119; 399/273

(58) Field of Classification Search
USPC ..... 399/119, 254, 256, 273, 283, 264
See application file for complete search history.

(56) References Cited

U.S. PATENT DOCUMENTS

| | | | | |
|---|---|---|---|---|
| 5,143,017 | A * | 9/1992 | Haneda et al. | 399/256 |
| 6,552,780 | B1 * | 4/2003 | Michlin et al. | 399/106 |
| 7,627,260 | B2 * | 12/2009 | Shiraishi et al. | 399/58 |
| 8,401,440 | B2 * | 3/2013 | Oba et al. | 399/269 |
| 2002/0071697 | A1 | 6/2002 | Fujimoto | |
| 2004/0033083 | A1 * | 2/2004 | Fukuyama et al. | 399/53 |
| 2009/0226220 | A1 | 9/2009 | Kunihiro et al. | |
| 2009/0257783 | A1 * | 10/2009 | Hatakeyama et al. | 399/256 |
| 2010/0098463 | A1 | 4/2010 | Matsumoto et al. | |
| 2011/0217085 | A1 * | 9/2011 | Hattori et al. | 399/254 |

FOREIGN PATENT DOCUMENTS

| | | |
|---|---|---|
| JP | 4-26872 | 1/1992 |
| JP | 6-301284 A | 10/1994 |
| JP | 10-63081 | 3/1998 |
| JP | 2000-214668 A | 8/2000 |
| JP | 2002-182474 A | 6/2002 |
| JP | 2002-287496 | 10/2002 |
| JP | 2005-4110 A | 1/2005 |
| JP | 2007-47637 | 2/2007 |
| JP | 2008-15253 A | 1/2008 |
| JP | 2009-210799 A | 9/2009 |

* cited by examiner

*Primary Examiner* — David Gray
*Assistant Examiner* — Carla Therrien
(74) *Attorney, Agent, or Firm* — Nixon & Vanderhye P.C.

(57) ABSTRACT

A developing device for an image forming apparatus includes a partition member for partitioning an internal space of the developing device into a first carrying and second carrying paths, and a sliding member provided adjacent a developing roller and having an inclined planar surface. Residual developer collected from a surface of the developing roller slides along the inclined planar surface of the sliding member toward the first carrying path P, and the developer hits an inclined carrying surface of the partition member. A first portion of the developer slides along the carrying surface of the partition member and falls into the second carrying path. An opening in the carrying surface of the partition member allows a second portion of the developer to pass through the partition member and into the first carrying path.

9 Claims, 10 Drawing Sheets

DEVELOPING DEVICE AND IMAGE FORMING APPARATUS

This Nonprovisional application claims priority under 35 U.S.C. §119(a) on Patent Application No. 2010-1 55079 filed in Japan on Jul. 7, 2010, the entire contents of which are hereby incorporated by reference.

TECHNICAL FIELD

The present invention relates to a circulation-type developing device for use in an electrophotographic image forming apparatus, which circulation-type developing device uses a two-component developer containing a toner and a magnetic carrier.

BACKGROUND ART

An image forming apparatus employing an electrostatic electrophotography printing method generally carries out steps of charging, exposing, developing, transferring, cleaning, charge removing, and fixing, so as to form an image. In a charging step, a surface of a photoreceptor which is driven to rotate is uniformly charged by a charging device. In an exposing step, the charged surface of the photoreceptor is irradiated with a laser beam emitted from an exposure device so that an electrostatic latent image is formed. Then, in a developing step, the electrostatic latent image formed on the photoreceptor is developed with a developer by a developing device so that a toner image is formed on the surface of the photoreceptor. After that, in a transferring step, the toner image formed on the photoreceptor is transferred to a recording material by a transfer device. Then, in a fixing step, the recording material is heated and pressured by a fixing device so that the toner image is fixed on the recording material. Further, in a cleaning step, a residual toner that has net been transferred in the transferring and remains on the surface of the photoreceptor is removed by a cleaning device so as to be collected into a predetermined collection section. Then, in a charge removing step, a residual charge is removed, by a charge removing device, from the surface of the photoreceptor that has been subjected to the cleaning step. The image forming apparatus becomes then ready for formation of a next image.

The developer used to develop the electrostatic latent image formed on the photoreceptor in the developing step is generally a single-component developer made of only a toner, or a two-component developer made of a toner and a carrier. The single-component developer contains no carrier. For this reason, with the single-component developer, it is unnecessary for the developing device to employ a stirring mechanism for mixing a toner and a carrier with each other uniformly, or the like. Accordingly, the single-component developer has an advantage of a simple arrangement of the developing device. However, the single-component developer also has disadvantages, such as an inconstant charge amount of the toner. On the other hand, with the two-component developer, it is necessary for the developing device to employ the stirring mechanism for mixing a toner and a carrier with each other uniformly, or the like. For this reason, the two-component developer has a disadvantage of a complex arrangement of the developing device. However, the two-component developer is excellent in stability of a charge amount of the toner. Accordingly, the two-component developer is now suitably used in devices such as a high-speed image forming apparatus and a color image forming apparatus.

In a case where an image forming apparatus uses such a two-component developer, a circulation-type developing device is employed so as to carry the developer quickly (see Patent Literature 1). As described in Patent Literature 1, the circulation-type developing device includes (i) first and second carrying paths through which a developer provided in a developing tank (a developing container, a developer container) is carried (circulated), and (ii) developer carrying members for carrying the developer in the respective first and second carrying paths while stirring the developer, which developer carrying members are provided in the respective first and second carrying paths. According to Patent Literature 1, each of the developer carrying members is a screw including a blade having a feed screw shape and a mesh screen member. In such a circulation-type developing device, a toner is supplied into the first carrying path from a toner hopper when a toner density of the developer in the developing tank becomes less than a predetermined value.

Further, Patent Literature 2 discloses a developing device in which (i) a partition plate having a plurality of opening slits is provided between a first carrying path provided on an outer side of the developing device and a second carrying path provided on an inner side (closer to a developer carrying member) of the developing device and (ii) the plurality of opening slits are formed such that an opening slit formed at a deeper position (downstream in the first carrying path) has a larger opening area.

CITATION LIST

Patent Literature

Patent Literature 1

Japanese Patent Application Publication, Tokukaihei, No. 10-63081 A (1998) (Publication Date: Mar. 6, 1998)

Patent Literature 2

Japanese Patent Application Publication, Tokukaihei, No. 04-26872 A (1992) (Publication Date: Jan. 30, 1992)

SUMMARY OF INVENTION

Technical Problem

Meanwhile, the circulation-type developing device has an arrangement in which the first carrying path (i) carries a supplied toner while stirring the supplied toner with a developer in the developing tank, and (ii), after the mixing of the toner and the developer is completed, supplies a resultant mixture to the second carrying path. A height of the developer in the first carrying path (a relative position of a surface of the developer with respect to the screw) has a big influence on efficiency in mixing the supplied toner and the developer with each other. Generally, a vertical height of the developer in the first carrying path is set to be in a range of ½ to ⅔ of a diameter of the screw serving as the developer carrying member so that efficiency in mixing them becomes as high as possible.

However, there is a case where the toner supplied to the first carrying path is carried (circulated) in the developing tank while it is not mixed with the existing developer sufficiently but aggregates in a mass, that is, a so-called toner-slipping state. Such a phenomenon is caused by swelling of the developer during a high-speed driving operation, an inconstant height balance of the developer circulating in the developing tank during an adjustable-speed driving operation, and the like. In other words, the toner is carried (circulated) while being separated from the carrier. This causes the toner to be charged insufficiently. Accordingly, the toner that has not been charged sufficiently (poorly-charged toner) is supplied to the developing roller (developer bearing member).

It is impossible to control the height of the developer in the first carrying path even with the use of the developer carrying member described in Patent Literature 1, which developer carrying member is a screw including a blade having a feed screw shape and a mesh screen member. The developer carrying member of Patent Literature 1 therefore has such a problem that the toner that has not been charged sufficiently is supplied to the developing roller.

Further, in a case where a plurality of opening slits are formed as described in Patent Literature 2, the toner that has not been stirred sufficiently is carried to the second carrying path via the plurality of opening slits. In this case, the toner that has not been charged sufficiently is also supplied to the developing roller.

Like the aforementioned devices, a conventional developing device has such a problem that (i) the toner that has not been charged sufficiently is supplied to the developing roller, and therefore (ii) the toner is scattered from the developing roller so that the inside of the image forming apparatus or an image formed by the image forming apparatus is spotted with the toner scattered from the developing roller. Moreover, in a case where the toner that has not been charged sufficiently is supplied to the developing roller, there is a reduction in adhesion of the toner to the electrostatic latent image formed on the photoreceptor (image bearing member). This causes such a problem that a photographic fog is likely to be generated on a developed image.

Further, when printing is carried out, with high-density, with respect to a plurality of sheets sequentially, an amount of a toner consumed on the surface of the developing roller is significantly increased. Under the circumstance, if the residual developer is collected toward directly below the developing roller, the stirring of the developer becomes late for the supply of the developer. This results in generation of a faded image. Here, the collected residual developer can be carried, by use of a sliding plate or the like, to upstream of a toner supply position, not toward directly below the developing roller. In this case, however, (i) the height balance of the developer in the developing tank becomes unstable, and (ii) efficiency in mixing the collected residual developer and the supplied toner with each other becomes poor. Therefore, the developer is circulated while being stirred insufficiently. This causes the toner to be scattered, and the scattered toner generates an image defect, such as a photographic fog.

The present invention is made in view of the problems. An object of the present invention is to provide a developer-circulation-type developing device for use in an image forming apparatus, which developing device (i) can constantly carry out stable mixing of a supplied toner, even during a high-speed driving operation or an adjustable-speed driving operation, and therefore (ii) reduces risks of scattering of the toner and generation of an image defect.

Solution to Problem

In order to attain the object, a developing device of the present invention includes: a developer containing section for containing a developer including a toner and a carrier; a first carrying member for carrying the developer while stirring the developer, the first carrying member being provided in the developer containing section; a second carrying member for carrying the developer while stirring the developer, the second carrying member (i) being provided, in the developer containing section, in parallel with the first carrying member and (ii) carrying the developer in a direction opposite to a direction in which the first carrying member carries the developer; a partition member for partitioning an internal space of the developer containing section into (a) a first carrying path in which the developer is carried by the first carrying member and (b) a second carrying path in which the developer is carried by the second carrying member, the partition member being provided between the first carrying member and the second carrying member; a supply opening via which the toner is supplied into the first carrying path, the supply opening being formed as a part of a cover section of the developer containing section; and a developing roller for supplying the developer from the second carrying path to an image bearing member in a developing area which is an area facing the image bearing member, the developing roller supplying the developer such a manner that the developing roller rotates while carrying the developer on a surface of the developing roller, the first carrying path and the second carrying path being connected to each other via spaces at both ends of the partition member, the developer being circulated through the first carrying path and the second carrying path, the developing device further including: a sliding member having an inclined plane for carrying a residual developer from the developing roller toward the first carrying path, which residual developer remains on the surface of the developing roller out of the developer provided on the surface of the developing member, the sliding member being provided downstream from the developing area in a rotational direction of the developing roller, the partition member having a carrying wall surface section for carrying a part of the residual developer received from the sliding member to the second carrying path, the carrying wall surface section being positioned downstream from the inclined plane of the sliding member, the carrying wall surface section having an opening section that is a through-hole facing the first carrying path.

Advantageous Effects of Invention

According to the arrangement, the partition member provided between the first and second carrying paths has the carrying wall surface section for carrying the part of the residual developer received from the sliding member to the second carrying path, and the carrying wall surface section has the opening section that is a through hole facing the first carrying path. Therefore, the residual developer carried on the sliding member is divided into, by the carrying wall surface section, (i) a part that is carried on the carrying wall surface section to the second carrying path, and (ii) another part that passes through the opening section to the first carrying path. That is, the residual developer that has been collected from the developing roller and carried on the sliding member is carried so that (i) the part of the residual developer which does not pass through the opening section collides against the carrying wall surface section, so as to be led to the second carrying path, and (ii) only the other part, an amount of which is suppressed by the opening section, passes through the opening section to the first carrying path. Here, the cover section of the developer containing section has the supply opening via which the toner is supplied. The toner is supplied to the first carrying path via the supply opening.

Therefore, it is possible to suppress, without being in proportion to an increase/decrease in driving speed of the developing device during a high-speed driving operation or an adjustable-speed driving operation, a change (a change in amount, a change in speed) of the part of the residual developer which is collected into the first carrying path, which change has a big influence on a property of mixing the supplied toner and the developer with each other. This suppresses a change in height of the developer in the first carrying path. Therefore, it is possible to (i) effectively mix the developer and the supplied toner with each other by the first carrying member, and (ii) prevent a reduction in stirring property during the high-speed driving operation or the adjustable-speed driving operation. It is therefore possible to (a) constantly carry out stable mixing of the supplied toner and (b) reduce risks of scattering of the toner and generation of an image defect.

Further, since an amount of the developer to be collected into the first carrying path can be limited by use of only the carrying wall surface section of the partition member, it is possible to (i) prevent the developing device from having a larger size and therefore suppress a production cost of the developing device.

DESCRIPTION OF EMBODIMENTS

One embodiment of the present invention is described below with reference to drawings.

<Image Forming Apparatus>

Figure 2:
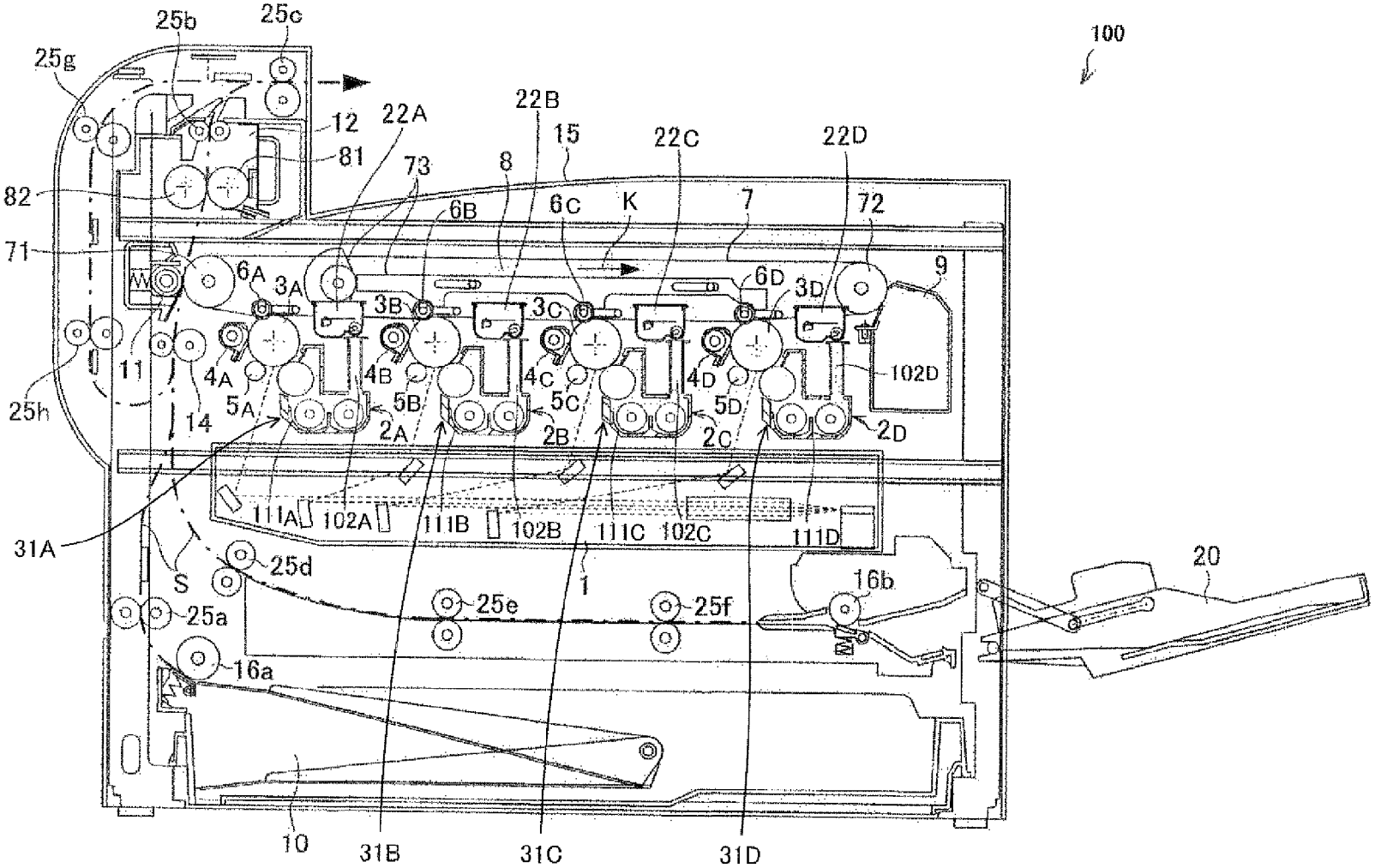
FIG. 2 is an explanatory view illustrating an entire arrangement of the image forming apparatus.

First, the following description deals with an entire configuration of an image forming apparatus employing a developing device in accordance with the present embodiment. FIG. 2 is a cross-sectional view schematically illustrating a configuration of an image forming apparatus 100 in accordance with the present embodiment. The image forming apparatus 100 forms an image by use of a toner in accordance with an electrophotographic technique.

The following embodiment describes a case where the image forming apparatus of the present invention is applied to a color-tandem-type image forming apparatus 100 for forming, in accordance with image data received from the outside, a multicolor image or a monochromatic image on a recording material, such as recording paper, a recording film, or a recording sheet. Note, however, that the present invention is not limited to this, and is applicable to any image forming apparatus, provided that it includes a developing device of the present invention.

The image forming apparatus 100 includes an exposure unit (exposure device) 1, four image forming stations (image forming sections) 31A through 31D, an intermediate transfer belt unit (transfer device) 8, a transfer roller 11, a fixing unit (fixing device) 12, an internal paper feeding tray 10, a manual paper feeding tray 20, a sheet carrying path S, and a paper output tray 15 (see FIG. 2). Further, a scanner and the like can be additionally provided above the image forming apparatus 100. Note that each operation of the members provided in the image forming apparatus 100 is controlled by a main control section constituted by a CPU (not illustrated) and the like.

The image forming apparatus 100 forms a black image, a cyan image, a magenta image, and a yellow image by use of respective color components of black (K), cyan (C), magenta (M), and yellow (Y), and forms a color image by overlapping the images of the color components with each other.

Accordingly, the image forming apparatus 100 includes, for the images of the respective four color components, four developing devices 2 (2A, 2B, 2C, 2D), four photoreceptors (image bearing members) 3 (3A, 3B, 3C, 3D), four chargers (charging devices) 5 (5A, 5B, 5C, 5D), and four cleaner units 4 (4A, 4B, 4C, 4D) (see FIG. 2). In other words, for each of the color components CMYK, one image forming station 31 (31A, 31B, 31C, 31D) including one developing device 2, one photoreceptor 3, one charger 5, and one cleaner unit 4, is provided. Four toner images are formed by the respective image forming stations 31A through 31D, and are caused to overlap each other on the intermediate transfer belt 7.

Note that the sign "A" indicates a member for forming a black image, the sign "B" indicates a member for forming a cyan image, the sign "C" indicates a member for forming a magenta image, and the sign "D" indicates a member for forming a yellow image. Note that, in the present embodiment, members that (i) are provided for formation of the respective black, cyan, magenta, and yellow images but (ii) are identical with each other in function are not provided with the signs A through D but with only numbers, for the sake of simple explanation.

The image forming station 31 has an arrangement in which (i) the photoreceptor 3 is provided as being rotatable and (ii) the charger 5, the developing device 2, and the cleaner unit 4 are provided, in this order, along a periphery of the photoreceptor in a rotational direction of the photoreceptor 3.

The charger 5 uniformly charges an entire surface of the photoreceptor 3 at a certain electric potential. In addition to a contact-roller charger illustrated in FIG. 2, examples of the charger 5 encompass a contact-brush charger and a non-contact charger.

The developing device 2 carries out a developing process for making an electrostatic latent image formed on the surface of the photoreceptor 3 visible by use of a toner. The developing device 2 includes a toner transfer mechanism 102 (102A, 102B, 102C, 102D), a toner supply device 22 (22A, 22B, 22C, 22D), and a developing tank (developer container) 111 (111A, 111B, 111C, 111D).

The toner supply device 22 in which an unused toner (toner powder) is stored is provided above the developing tank 111. The toner is supplied from the toner supply device 22 to the developing tank 111 via the toner transfer mechanism 102.

The cleaner unit 4 removes a residual toner that remains on the surface of the photoreceptor 3 after the toner image is transferred to the intermediate transfer belt 7, so as to collect the residual toner.

The exposure unit 1 causes the photoreceptor 3 charged by the charger 5 to be exposed in accordance with image data, so as to form an electrostatic latent image on a surface of the photoreceptor 3 in accordance with the image data. The exposure unit 1 is a laser scanning unit (LSU) including a laser illumination section and a reflecting mirror (see FIG. 2). Note, however, that, the exposure unit 1 is not limited to the laser scanning unit, and may be an EL (electroluminescence) element in which light emitting elements are arrayed, or an LED writing head. The exposure unit 1 causes the photoreceptor 3 charged by the charger 5 to be exposed in accordance with image data inputted into the image forming apparatus 100, so as to form an electrostatic latent image on the surface of the photoreceptor 3 in accordance with the image data.

The intermediate transfer belt unit 8 is provided above the photoreceptor 3. The intermediate transfer belt unit 8 includes intermediate transfer rollers 6 (6A, 6B, 6C, 6D), an intermediate transfer belt 7, an intermediate transfer belt driving roller 71, an intermediate transfer belt driven roller 72, an intermediate transfer belt tension mechanism 73, and an intermediate transfer belt cleaning unit 9.

The intermediate transfer rollers 6, the intermediate transfer belt driving roller 71, the intermediate transfer belt driven roller 72, and the intermediate transfer belt tension mechanism 73 are arranged so as to (i) cause the intermediate transfer belt 7 to be in a tensioned state and (ii) drive the intermediate transfer belt 7 to rotate in a direction indicated by an arrow K shown in FIG. 2.

The intermediate transfer rollers 6 are rotatably held by respective intermediate transfer roller attachment sections of the intermediate transfer belt tension mechanism 73 of the intermediate transfer belt unit 8. A transfer bias voltage is applied to each of the intermediate transfer rollers 6 so that a toner image formed on the corresponding photoreceptor 3 is transferred to the intermediate transfer belt 7.

The intermediate transfer belt 7 is in contact with the photoreceptor 3. Toner images for the respective color components, formed on the respective photoreceptors 3, are sequentially transferred onto the intermediate transfer belt 7 so that the toner images overlap each other. A color toner image (multicolor toner image) is formed in this manner. The intermediate transfer belt 7 is made of a film having a thickness in a range of 100 μm to 150 μm, for example, and has a shape having no ends.

The transfer of the toner image from the photoreceptor 3 to the intermediate transfer belt 7 is carried out by the intermediate transfer roller 6 that is in contact with a back surface of the intermediate transfer belt 7. The transfer bias voltage is applied to the intermediate transfer roller 6 so as to transfer the toner image to the intermediate transfer belt 7. The transfer bias voltage is a high voltage having a polarity (+) opposite to a polarity (−) of the charging of the toner.

The intermediate transfer roller 6 has a metal (stainless steel, for example) shaft having a diameter in a range of 8 mm to 10 mm, for example, which metal shaft serves as a base of the intermediate transfer roller 6. A surface of the intermediate transfer roller 6 is covered with a conductive elastic material (e.g., an EPDM or urethane foam). The conductive elastic material allows the intermediate transfer roller 6 to uniformly apply a high voltage to the intermediate transfer belt 7. According to the present embodiment, the intermediate transfer roller 6 having a roller shape is used as a transfer electrode. Note, however, that the intermediate transfer roller 6 is not limited to this, and may have a brush shape.

As described above, electrostatic latent images formed on the respective the photoreceptors 3A through 3D are made visible by use of toners corresponding to the respective color components. In this manner, the toner images are generated. These toner images are caused to overlap and be stacked with each other on the intermediate transfer belt 7. The toner images stacked with each other are carried, by rotation of the intermediate transfer belt 7, to a contact position (transfer section) between a recoding material being carried and the intermediate transfer belt 7. The toner images are transferred onto the recording material at the contact position by the transfer roller 11 provided at the contact position. In this case, the intermediate transfer belt 7 and the transfer roller 11 are pressed against each other at a predetermined nip pressure, while a voltage for transferring the toner images to the recording material is applied to the transfer roller 11. The voltage is a high voltage having a polarity (+) opposite to a polarity (−) of the charging of the toner.

In order to maintain the predetermined nip pressure, one of the transfer roller 11 and the intermediate transfer belt driving roller 71 is made from a hard material such as a metal, while the other is made from an elastic material such as an elastic roller (e.g., an elastic rubber roller or a foamable resin roller).

The toner that has been provided on the intermediate transfer belt 7 by a physical contact between the intermediate transfer belt 7 and the photoreceptor 3 but has not been transferred to the recording material from the intermediate transfer belt 7 may cause a color mixture of toners in a subsequent step. Therefore, such a residual toner is removed and collected by the intermediate transfer belt cleaning unit 9. The intermediate transfer belt cleaning unit 9 includes, for example, a cleaning blade that is in contact with the intermediate transfer belt 7. A back surface of the intermediate transfer belt 7 is supported by the intermediate transfer belt driven roller 72 at a position where the intermediate transfer belt 7 is in contact with the cleaning blade.

In the internal paper feeding tray 10, the recording material (the recording paper, the recording film, the recording sheet) on which an image is to be formed is stored. According to the present embodiment, the internal paper feeding unit tray 10 is provided below the image forming stations 31A through 31D and the exposure unit 1. Further, the manual paper feeding tray 20 is foldably provided on a side wall of the image forming apparatus 100. The manual paper feeding tray 20 is used when the recording material is fed manually. Meanwhile, the paper output tray 15 provided at an upper part of the image forming apparatus 100 is a tray to which a recording material on which an image has been formed is to be outputted.

Further, the image forming apparatus 100 includes a sheet carrying path S through which the recording material stored in the internal paper feeding tray 10 and the recording material fed to the manual paper feeding tray 20 are carried to the paper output tray 15 via the transfer section, the fixing unit 12, etc.

Further, the sheet carrying path S is provided with pickup rollers 16 (16*a*, 16*b*), a registration roller 14, the transfer section, the fixing unit 12, a plurality of carrying rollers 25 (25*a* through 25*h*), etc. Note that the transfer section is provided between the intermediate transfer belt driving roller 71 and the transfer roller 11.

Each of the plurality of carrying rollers 25 is a small roller for accelerating and supporting conveyance of the recording material, and is provided along the sheet carrying path S. The pickup roller 16*a* is provided at an end of the internal paper feeding tray 10. The pickup roller 16*a* is a suction roller for supplying the recording material one by one from the internal paper feeding tray 10 to the sheet carrying path S. The pickup roller 16*b* is provided in the vicinity of the manual paper feeding tray 20. The pickup roller 16*b* is a suction roller for supplying the recording material one by one from the manual paper feeding tray 20 to the sheet carrying path S. The registration roller 14 (i) temporarily holds the recording material being carried through the sheet carrying path S, and (ii) supplies the recording material to the transfer section at certain timing so that an end of a toner image formed on the intermediate transfer belt 7 and an end of the recording material match each other.

The fixing unit 12 includes a heat roller 81 and a pressure roller 82. The heat roller 81 and the pressure roller 82 sandwich the recording material and rotate. The heat roller 81 is controlled to be at a predetermined fixing temperature by a control section (not illustrated). The control section controls the temperature of the heat roller on the basis of a detection signal received from a thermometer (not illustrated).

The heat roller 81 carries out, in combination with the pressure roller 82, thermocompression with respect to the recoding material so that the toner images of the respective color components are melt, mixed with each other, and provided on the recording material with pressure. Heat-fixing of the toner images to the recording material is carried out in this manner. Note that the recording material on which the toner images of the respective color components (color toner images) are fixed is carried to an inversion paper output path of the sheet carrying path S by the plurality of the carrying rollers 25, and then is inverted (state where the multicolor toner image faces downward), after that, is outputted to the paper output tray 15 in the inverted state.

Next, the following description deals with how a recording material carrying operation is carried out by the sheet carrying path S.

The following description deals with one-side printing. The recording material supplied from the internal paper feeding tray 10 is picked up by the pickup roller 16*a*, and then is carried to the registration roller 14 by the carrying roller 25*a* in the sheet carrying path S, after that, is supplied to the transfer section (the contact position between the transfer roller 11 and the intermediate transfer belt 7) by the registration roller 14 at certain timing so that an end of the recording material and an end of each of the toner images stacked with each other match each other. The toner images are transferred to the recording material at the transfer section, and are fixed on the recording material by the fixing unit 12. Then, the recording material is carried by the carrying roller 25*b*, and then outputted to the paper output tray 15 by the paper output roller 25*c*.

Further, the recording material supplied from the manual paper feeding tray 20 is picked up by the pickup roller 16*b*, and then is carried to the registration roller 14 by the plurality of carrying rollers 25 (25*f*, 25*e*, 25*d*). After being carried to the registration roller 14, the recording material is subjected to the printing and then outputted to the paper output tray 15 in the same manner as the recording material supplied from the internal paper feeding tray 10.

On the other hand, in a case of two-sided printing, the recording material is, first, subjected to the one-side printing as described above, and then is received by the paper output roller 25*c* from the fixing unit 12. A rear end of the recording material is chucked by the paper output roller 25*c*, and then the recording material is led to the carrying rollers 25*g* and 25*h* by inverse rotation of the paper output roller 25*c*. After that, the recording material is carried to the registration roller 14 again, and then is subjected to the printing process for its surface opposite to the surface that has been subjected to the printing. Ultimately, the recording material is outputted to the paper output tray 15.

Next, the following description deals with details of a configuration of the toner supply device 22.

Figure 3:
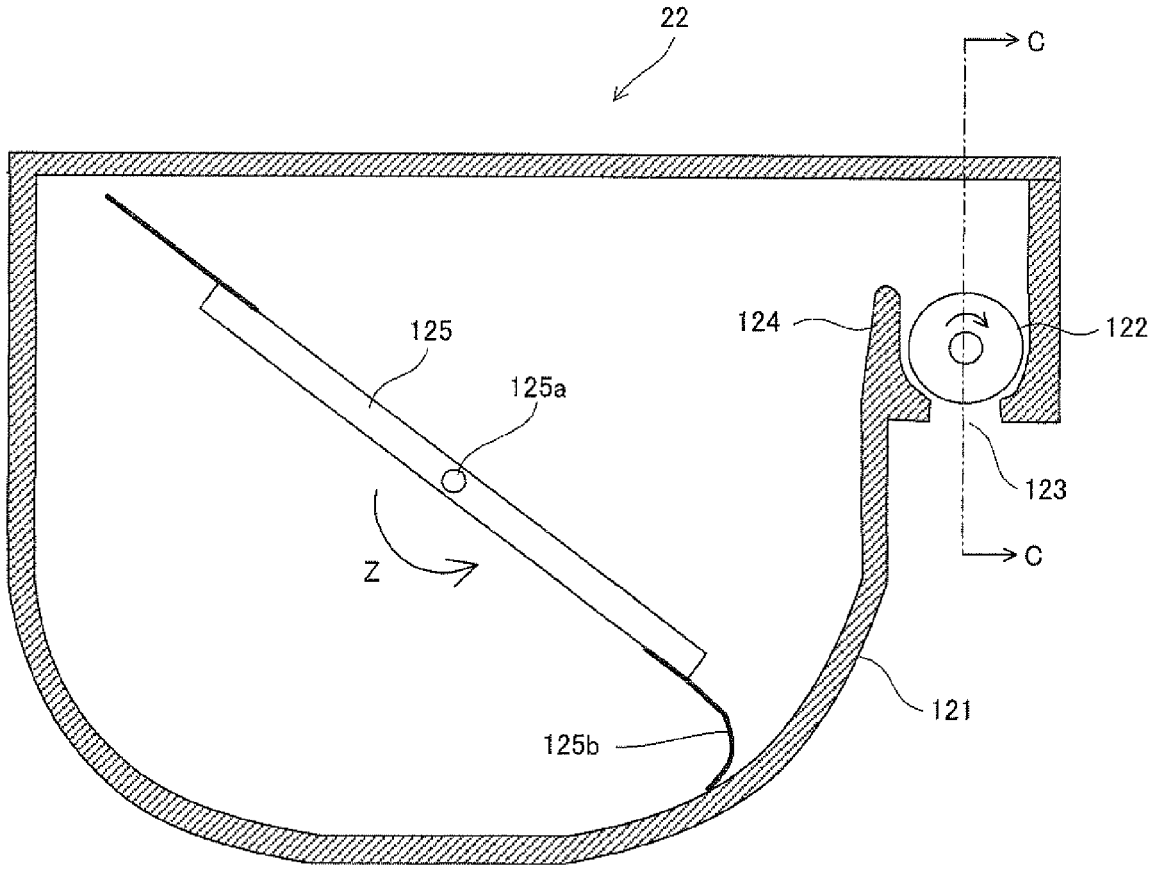
FIG. 3 is a cross-sectional view schematically illustrating a configuration of a toner supply device included in the image forming apparatus.
Figure 4:
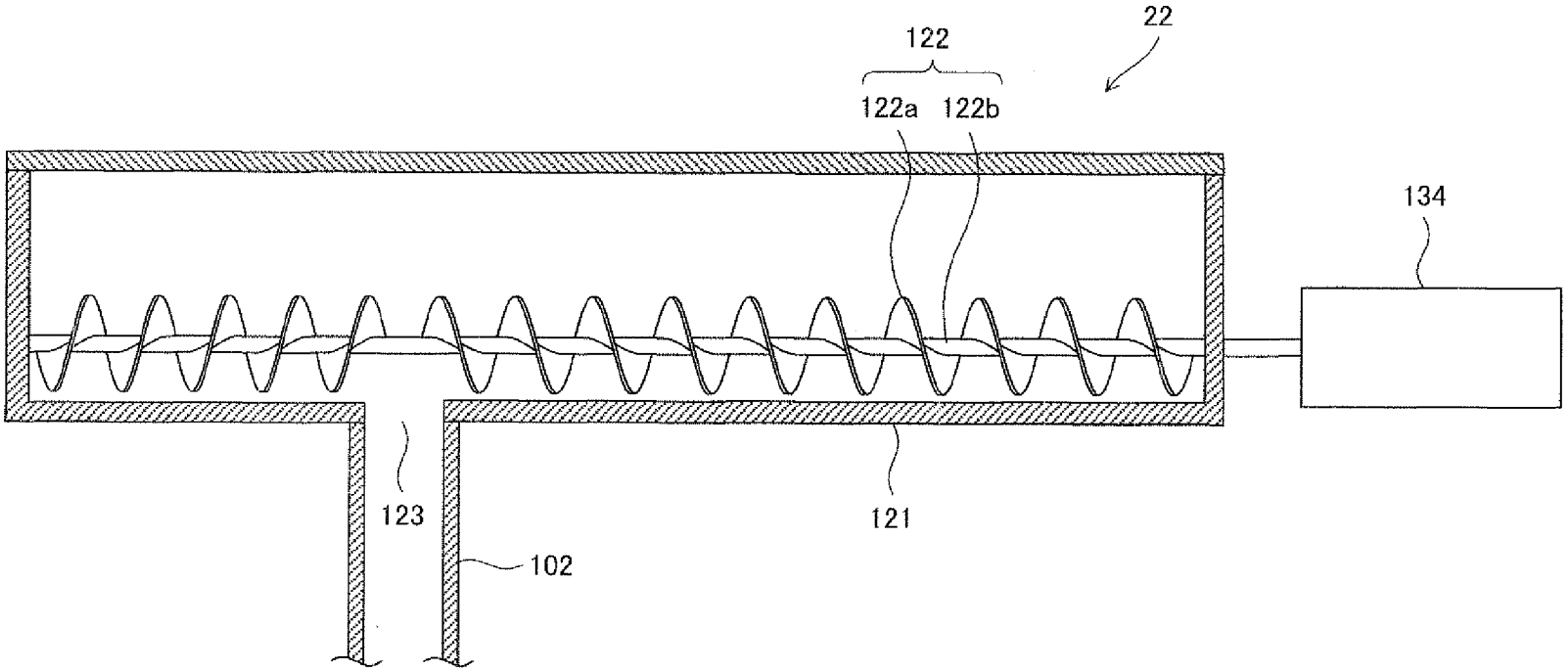
FIG. 4 is a cross-sectional view illustrating the toner supply device illustrated in FIG. 3, taken along the line

FIG. 3 is a cross-sectional view schematically illustrating the configuration of the toner supply device 22 of the image forming apparatus 100, and FIG. 4 is a cross-sectional view taken along the line C-C shown in FIG. 3.

The toner supply device 22 includes a toner container 121, a toner-stirring member 125, a toner discharge member 122, and a toner discharge opening 123 (see FIG. 3). The toner supply device 22 in which an unused toner (toner powder) is stored is provided above the developing tank 111. The unused toner stored in the toner supply device 22 is supplied, by rotation of the toner discharge member (output screw) 122, to the developing tank 111 via the toner discharge opening 123 and the toner transfer mechanism 102.

The toner container 121 is a container having a columnar shape whose base has a shape substantially identical with a half circle, which columnar shape has an internal space. The toner container 121 has the toner-stirring member 125 and the toner discharge member 122 so that the toner-stirring member 125 and the toner discharge member 122 are rotatable. A toner is stored in the toner container 121. The toner discharge opening 123 is an opening whose shape is substantially identical with a rectangle. The discharge opening 123 is formed (i) below the toner discharge member 122 and (ii) in the vicinity of a center of the toner discharge member 122 in an axial direction of the toner discharge member 122, so as to face the toner transfer mechanism 102.

The toner-stirring member 125 is a plate member which rotates around a rotary shaft 125*a* so as to scoop the toner stored in the toner container 121 up to the toner discharge member 122 while stirring the toner. The toner-stirring member 125 has toner-scooping members 125*b* at its ends, respectively. The toner-scooping members 125*b* are made of, for example, a material having flexibility such as a polyethylene terephthalate (PET), and are attached to respective ends of the toner-stirring member 125.

The toner discharge member 122 supplies the toner stored in the toner container 121 to the developing tank 111 via the toner discharge opening 123. The toner discharge member 122 is constituted by a screw auger including a toner carrying blade 122*a* and a toner discharge member rotary shaft 122*b* (see FIG. 4). The toner discharge member 122 can be driven to rotate by a toner discharge member driving motor 134. The toner carrying blade 122*a* of the screw auger is arranged so that the toner is moved toward the toner discharge opening 123 from both ends of the toner discharge member 122 in the axial direction of the toner discharge member 122.

A toner discharge member blocking wall 124 is provided between the toner discharge member 122 and the toner-stirring member 125. With the arrangement, the toner scooped up by the toner-stirring member 125 is adjusted in an amount so that an appropriate amount of the toner is retained around the toner discharge member 122.

The toner-stirring member 125 rotates in a Z direction shown in FIG. 3 so as to stir the toner and scoop up the toner toward the toner discharge member 122. Here, the toner-scooping members 125*b* have flexibility so as to change their shapes, as sliding along an internal wall of the toner container 121. With the arrangement, the toner scooping members 125*b* can supply the toner toward the toner discharge member 122. The toner discharge member 122 rotates so as to lead the supplied toner to the toner discharge opening 123.

<Developing Device>

Figure 1:
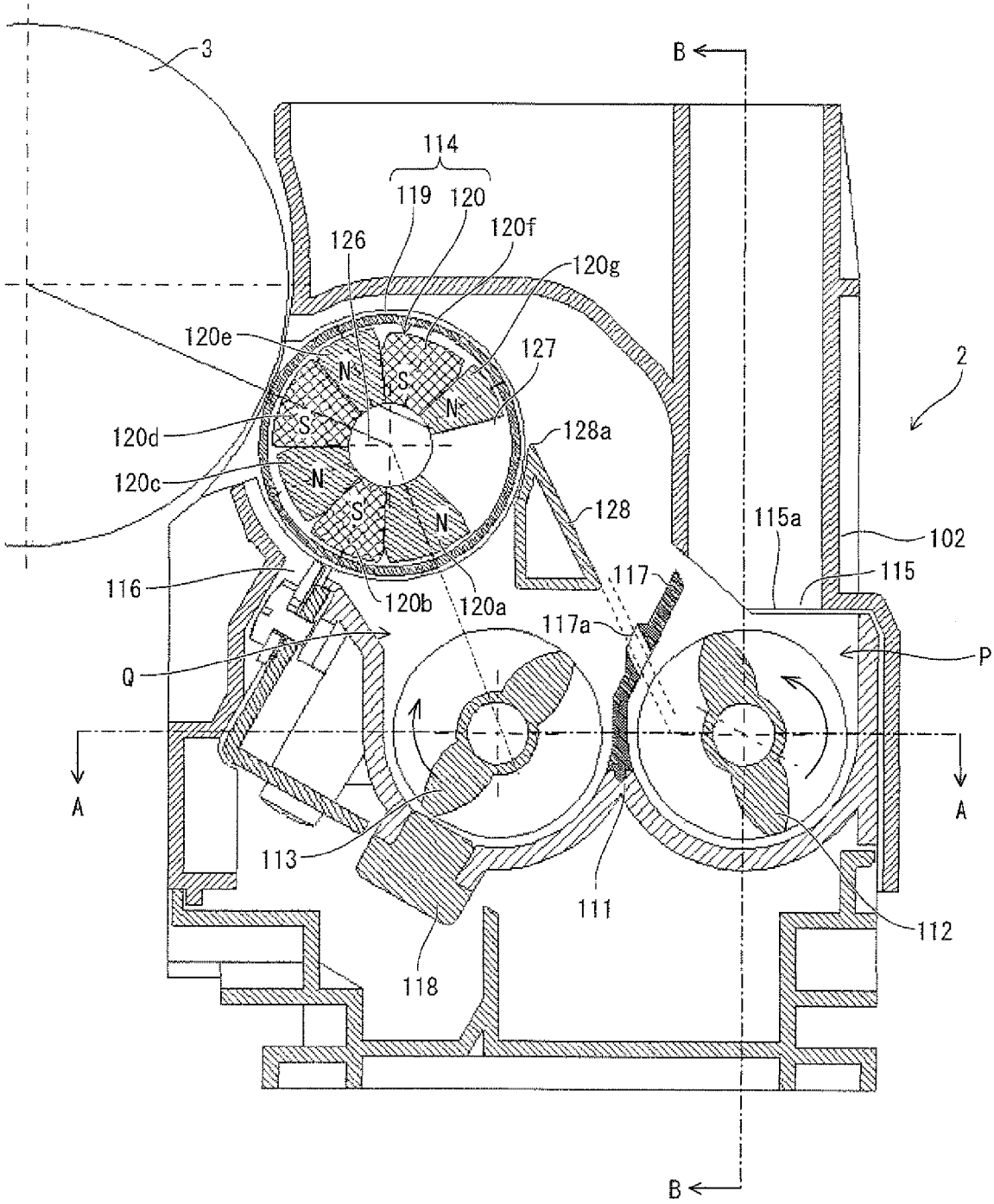
FIG. 1 is a cross-sectional view illustrating a configuration of a developing device included in an image forming apparatus in accordance with an embodiment of the present invention.
Figure 5:
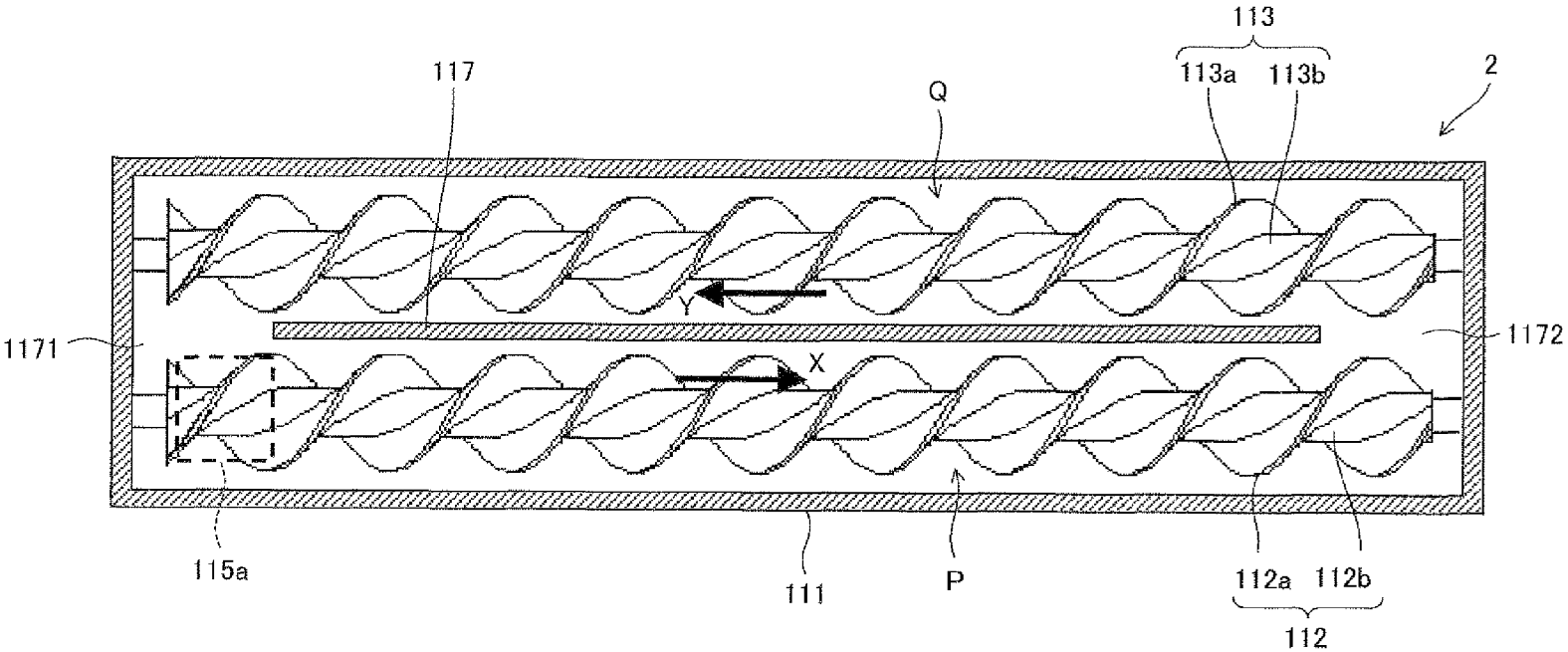
FIG. 5 is a cross-sectional view illustrating the developing device illustrated in FIG. 1, taken along the line A-A.
Figure 6:
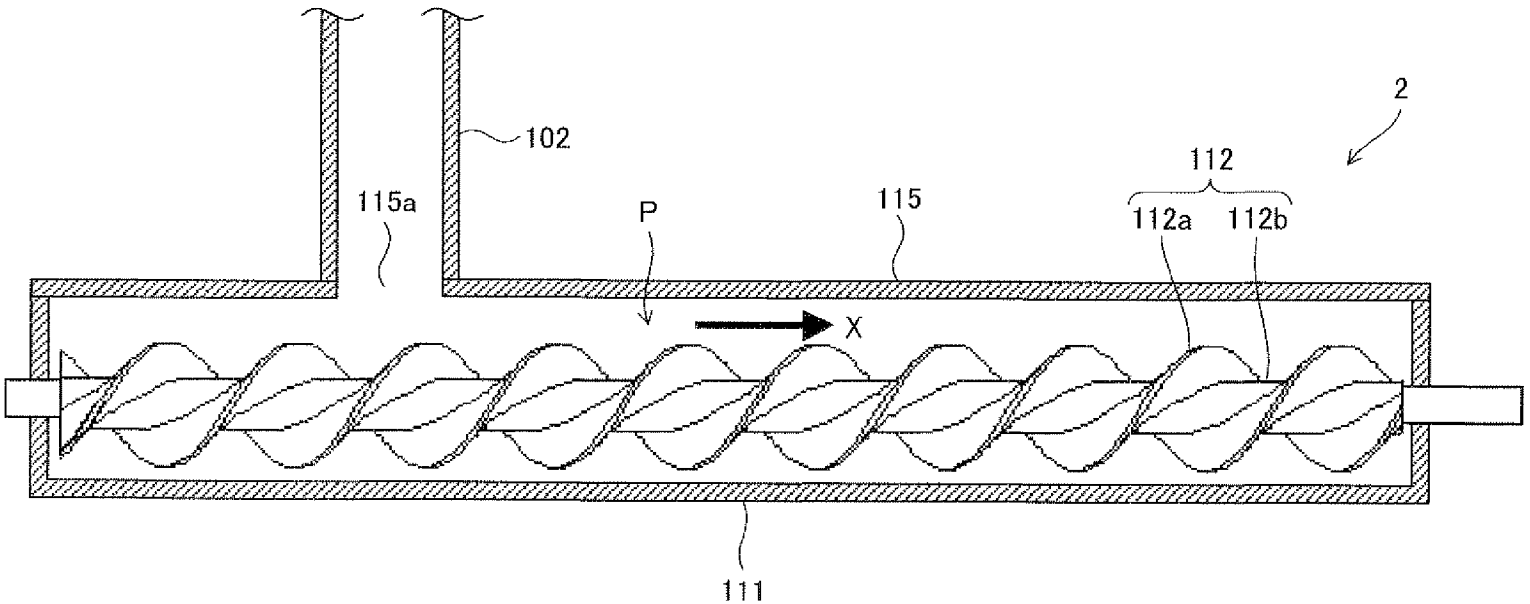
FIG. 6 is a cross-sectional view illustrating the developing device illustrated in FIG. 1, taken along the line B-B.

Next, the following description deals with a characteristic developing device 2 in accordance with the present embodiment, with reference to drawings. FIG. 1 is a cross-sectional view illustrating a configuration of the developing device 2 of the present embodiment, included in the image forming apparatus 100 of the present embodiment. FIG. 5 is a cross-sectional view taken along the line A-A shown in FIG. 1, and FIG. 6 is a cross-sectional view taken along the line B-B shown in FIG. 1.

The developing device 2 includes a developing roller 114 which is provided in the developing tank 111 to face the photoreceptor 3 (see FIG. 1). The developing device 2 supplies, by use of the developing roller 114, a toner to the surface of the photoreceptor 3, so as to make an electrostatic latent image formed on the surface of the photoreceptor 3 visible (developed).

In addition to the developing roller 114 and the developing tank 111, the developing device 2 includes a developing tank cover (cover section) 115, a toner supply opening 115*a*, a doctor blade 116, a first carrying member 112, a second carrying member 113, a partition plate (partition member) 117, and a permeability sensor 118.

The developing tank 111 is a tank for storing a two-component developer including a toner and a carrier (hereinafter, merely referred to as "developer" for the sake of simple explanation). In the developing tank 111, the developing roller 114, the first carrying member 112, the second carrying member 113, and the like are provided.

Note that the carrier used in the present embodiment is a magnetic carrier having magnetism. Specific examples of magnetic particles encompass metal particles such as particles of iron, ferrite, or magnetite, and particles of an alloy of such a metal and a metal such as aluminum or lead. Among these, ferrite particles are particularly preferable. Alternatively, the magnetic particles can be a resin coating carrier in which magnetic particles are coated with a resin, a resin dispersed carrier in which magnetic particles are dispersed in a resin, or the like.

Further, the developing tank cover 115 is provided detachable at an upper part of the developing tank 111 (see FIG. 1). Furthermore, the developing tank cover 115 has a toner supply opening 115*a* via which an unused toner is supplied into the developing tank 111. The toner supply opening 115*a* is connected to the toner transfer mechanism 102 of the toner supply device 22. Accordingly, the unused toner stored in the toner supply device 22 is transferred into the developing tank 111 via the toner transfer mechanism 102 and the toner supply opening 115*a*. The unused toner is supplied into the developing tank 111 in this manner.

The first carrying member 112 and the second carrying member 113 are juxtaposed to each other in the developing tank 111 (see FIG. 5). In the developing tank 111, the partition plate 117 is provided between the first carrying member 112 and the second carrying member 113 (see FIGS. 1 and 5). The partition plate 117 extends in parallel with (i) an axial direction (a direction in which the rotary shaft extends) of the first carrying member 112 and (ii) an axial direction (a direction in which the rotary shaft extends) of the second carrying member 113. The partition plate 117 partitions an internal space of the developing tank 111 into a first carrying path P in which the first carrying member 112 is provided and a second carrying path Q in which the second carrying member 113 is provided.

The partition plate 117 is provided so that both ends of the partition plate 117 in the axial direction of the first carrying member 112 and the second carrying member 113 are not in contact with any internal side wall of the developing tank 111 (see FIG. 5). That is, in the vicinity of each of the ends of the partition plate 117 in the axial direction of the first carrying member 112 and the second carrying member 113, there is a communicating path via which the first carrying path P and the second carrying path Q are connected. Hereinafter, a communicating path formed on a downstream side of the first carrying path P (downstream in a direction indicated by an arrow X) is referred to as "first communicating path 1172", whereas a communicating path formed on a downstream side of the second carrying path Q (downstream in a direction indicated by an arrow Y) is referred to as "second communicating path 1171" (see FIG. 5).

Note that the partition plate 117 will be described in detail later.

The first carrying member 112 and the second carrying member 113 are provided such that (i) their outer surfaces face each other via the partition plate 117 and (ii) their axes are parallel to each other. The first carrying member 112 and the second carrying member 113 are set to rotate in inverse directions with respect to each other. Therefore, the first carrying member 112 and the second carrying member 113 carry the developer in the directions opposite to each other, respectively, while stirring the developer. The first carrying member 112 carries the developer in the direction indicated by the arrow X, whereas the second carrying member 113 carries the developer in the direction indicted by the arrow Y, which is opposite to the direction indicated by the arrow X (see FIG. 5).

As described above, the developing device 2 is a circulation-type developing device in which the developer is circulated through the first carrying path P and the second carrying path Q.

The first carrying member 112 is constituted by a screw auger including a first spiral carrying blade 112*a* and a first rotary shaft 112*b* (see FIG. 5). Similarly, the second carrying member 113 is constituted by a screw auger including a second spiral carrying blade 113*a* and a second rotary shaft 113*b*. The first carrying member 112 and the second carrying member 113 are driven by driving means such as a motor (not illustrated) so as to rotate. By the rotation of the first carrying member 112 and the second carrying member 113, the developer is stirred and carried.

The developing roller 114 is provided to face, but not in contact with, the photoreceptor 3 (with a space between them) (see FIG. 1). The developer carried by the developing roller 114 is in contact with the photoreceptor 3 at an area where the developing roller 114 and the photoreceptor 3 are closest to each other. The contact area serves as a developing area (developing nip section). In the developing area, a developing bias voltage is applied to the developing roller 114 from a power source (not illustrated) connected to the developing roller 114, so that the toner is supplied from the developer on the surface of the developing roller 114 to an electrostatic latent image formed on the surface of the photoreceptor 3.

The developing roller 114 includes a developing sleeve 119 and a magnet roller 120 (see FIG. 1). The developing roller 114 (i) scoops the developer in the developing tank 111 to the surface of the developing sleeve 119 by magnetic force of the magnet roller 120, (ii) holds (captured) the developer on the surface of the developing sleeve 119, and then (iii) supplies the toner contained in the developer held on the surface of the developing sleeve to the photoreceptor 3.

The developing sleeve 119 is a circular cylinder member that (i) is made of a nonmagnetic material such as aluminum or stainless steel and (ii) constitutes a periphery part of the developing roller 114. The developing sleeve 119 rotates in one direction (a clockwise direction in FIG. 1) on an outer surface of the magnet roller 120, so as to carry the developer while holding the developer by the magnetic power of the magnet roller 120.

According to the present embodiment, the magnet roller 120 is formed such that 7 magnetic poles (a first magnetic pole 120*a* through a seventh magnetic pole 120*g*) are fixed to a magnet fixing shaft 126. That is, the seven magnetic poles are provided integral with each other.

The first magnetic pole 120*a* is positioned so as to face the developer that is stirred and carried in the developing tank 111. Specifically, the first magnetic pole 120*a* is provided so as to face the second carrying member 113. The first magnetic pole 120*a* is a scooping magnetic pole for scooping, to the developing sleeve 119, the developer that is stirred and carried by the second carrying member 113 (causing the developer to be captured by (absorbed to) the developing sleeve 119), According to the present embodiment, the first magnetic pole 120*a* is constituted by the north pole. Note that the scooping magnetic pole 120*a* can be the south pole provided that the north poles and the south poles are arranged alternately so that neighboring poles of the first magnetic pole 120*a* through the seventh magnetic pole 120*g* are opposite to each other in polarity. Furthermore, the number of the magnetic poles is not limited to 7, and can be 5, for example.

During a normal image forming operation, first, the developer provided in the developing tank 111 is scooped toward the developing roller 114 by use of a magnetic line created by the first magnetic pole 120*a*.

The second magnetic pole 120*b* is provided adjacent to the first magnetic pole 120*a* on a downstream side in the rotational direction of the developing sleeve 119 (the clockwise direction in FIG. 1). The second magnetic pole 120*b* is the south pole. The second magnetic pole 120*b* is provided so that the magnetic power of the second magnetic pole 120*b* is substantially strongest in an area where a surface of the developing sleeve 119 faces the doctor blade 116. The developer is scooped up to the surface of the developing sleeve 119 by use of a magnetic line created by the second magnetic pole 120*b*, and then is stably carried to downstream in the rotational direction of the developing sleeve 119. A layer thickness of the developer carried on the surface of the developing sleeve 119 is made uniform by the doctor blade 116.

The third magnetic pole 120*c* is provided adjacent to the second magnetic pole 120*b* on the downstream side in the rotational direction of the developing sleeve 119. The third magnetic pole 120*c* is the north pole. A magnetic line created by the third magnetic pole 120*c* contributes to stable conveyance of the developer on the developing sleeve 119 from the third magnetic pole 120*c* to the downstream forth magnetic pole 120*d* in the rotational direction of the developing sleeve 119, which developer has been made uniform in thickness by the doctor blade 116.

The fourth magnetic pole 120*d* is provided adjacent to the third magnetic pole 120*c* on the downstream side in the rotational direction of the developing sleeve 119. The fourth magnetic pole 120*d* is the south pole. The fourth magnetic pole is provided to face the photoreceptor 3, and serves as a main magnetic pole to form an image. The developer carried from the third magnetic pole 120*c* is slid against the photoreceptor 3 by a magnetic brush of the developer, which magnetic brush is created by a magnetic line of the fourth magnetic pole 120*d*. The area where (i) the magnetic brush is created and (ii) the photoreceptor 3 and the developing sleeve 119 face each other is the developing area.

The fifth magnetic pole 120*e* is provided adjacent to the fourth magnetic pole 120*d* on the downstream side in the rotational direction of the developing sleeve 119. The fifth magnetic pole 120*e* is the north pole. The developer carried from the position of the fourth magnetic pole 120*d* is held by the developing sleeve 119 by use of a magnetic line created by the fifth magnetic pole 120*e*, and then further carried toward downstream in the rotational direction of the developing sleeve 119.

The sixth magnetic pole 120*f* is provided adjacent to the fifth magnetic pole 120*e* on the downstream side in the rotational direction of the developing sleeve 119. The sixth magnetic pole 120*f* is the south pole. The developer carried from the position of the fifth magnetic pole 120*e* is held by the developing sleeve 119 by use of a magnetic line created by the sixth magnetic pole 120*f*, and then further carried to downstream in the rotational direction of the developing sleeve 119.

The seventh magnetic pole 120*g* is provided adjacent to the sixth magnetic pole 120*f* on the downstream side in the rotational direction of the developing sleeve 119. The seventh magnetic pole 120*g* is the north pole. The seventh magnetic pole is identical with the first magnetic pole 120*a* in polarity (according to the present embodiment, the north pole). No magnetic pole is provided in an area 127, on the developing sleeve 119, between the seventh magnetic pole 120*g* and the first magnetic pole 120*a*, and therefore no magnetic line is created in the area 127. Accordingly, the developer held by the seventh magnetic pole 120*g* is released from the developing sleeve 119 in the area 127. For this reason, the area 127 is referred to as "developer releasing region 127".

According to the present embodiment, the developer released from the developing sleeve 119 in the developer releasing region 127 is moved toward a sliding plate (sliding member) 128.

The sliding plate 128 is provided, in the developing tank 111, downstream from the developing area in the rotational direction of the developing roller 114. The sliding plate 128 leads, by use of its inclined plane, the developer that remains on the surface of the developing roller 114 from the developing roller 114 toward the first carrying path P.

The sliding plate 128 is provided so as to be parallel with the developing roller 114 in a longitudinal direction of the sliding plate 128. An end 128*a* of the sliding plate 128 in a direction in which short sides of the sliding plate 128 extend faces, but not in contact with, the surface of the developing roller 114, whereas the other end of the sliding plate 128 in the direction in which the short sides of the sliding plate 128 extend is positioned above the first carrying member 112 and the second carrying member 113. The inclined plane of the sliding plate 128 extends from the developing roller 114 toward the partition plate 117. Accordingly, the developer led from the developing roller 114 to the sliding plate 128 slides on the inclined plane of the sliding plate 128, and then is collected into a circulation path section constituted by the first carrying path P and the second carrying path Q in the developing tank 111.

Figure 7:
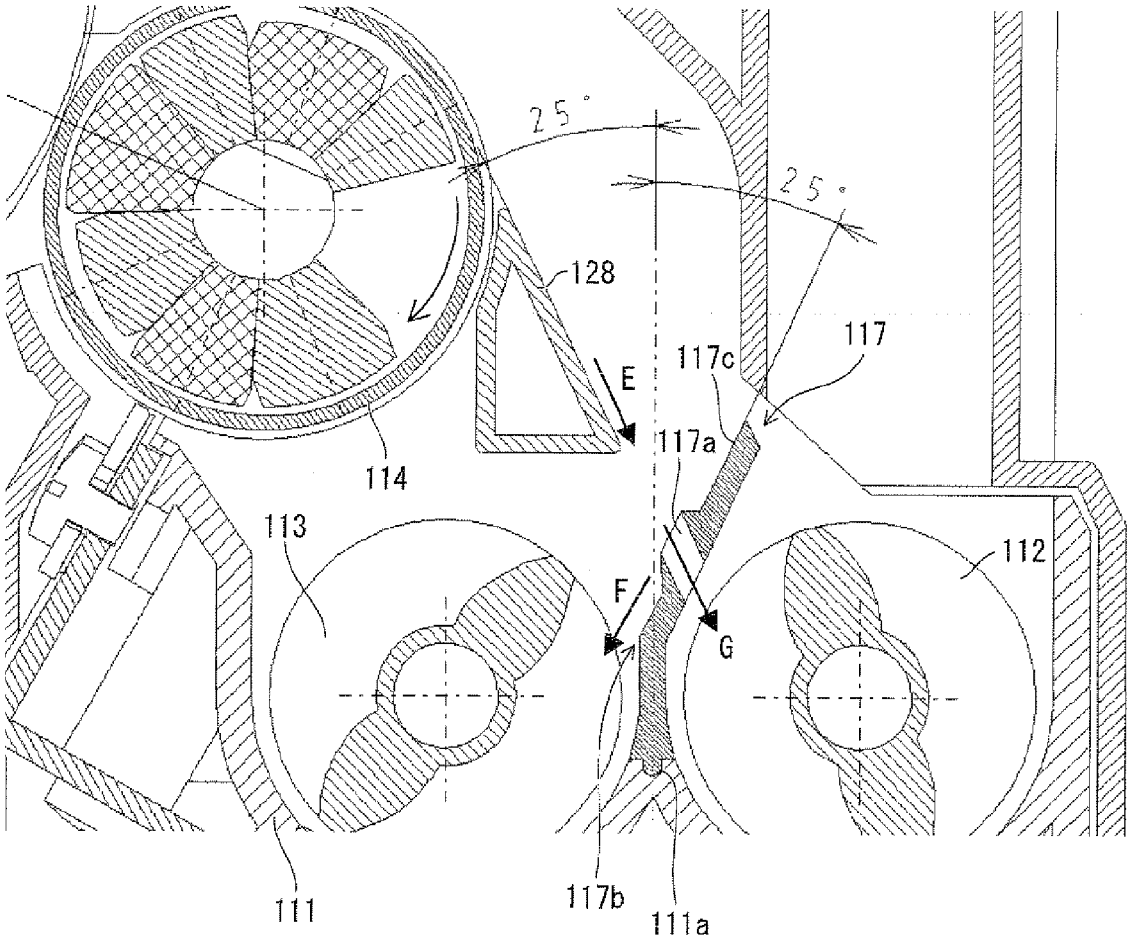
FIG. 7 is an enlarged view of a part of the developing device illustrated in FIG. 1, illustrating an arrangement of a partition plate cross-sectionally.

FIG. 7 is an enlarged view illustrating an area in the vicinity of the sliding plate 128 and the partition plate 117 shown in FIG. 1. According to the present embodiment, the partition plate 117 limits an amount of the developer to be collected into the first carrying path P. The developer provided on the developing roller 114 slides on the inclined plane of the sliding plate 128 in a direction indicated by an arrow E, so as to be carried toward the partition plate 117.

The partition plate 117 is fixed, by an alignment groove 111*a* formed in the developing tank 111, at a substantial center position between the first carrying member 112 and the second carrying member 113, so as to extend in a direction parallel to each axial direction of the first carrying member 112 and the second carrying member 113.

Further, according to the present embodiment, the partition plate 117 has an inclined plane (carrying wall surface section)

117*c* that is inclined from a start point 117*b* toward the first carrying member 112. Downstream from the inclined plane of the sliding plate 128, the inclined plane 117*c* carries, to the second carrying path Q, a part of the developer received from the sliding plate 128 (a part of the developer that has slid on the inclined plane of the sliding plate 128). The inclined plane 117*c* is provided along the longitudinal direction of the partition plate 117, and has a length not less than that of the partition plate 117 in the longitudinal direction. The inclined plane 117*c* has the same angle of inclination as that of the inclined plane of the sliding plate 128, and is provided to face the inclined plane of the sliding plate 128. Further, the inclined plane 117*c* has a slit 117*a* which is a through-hole facing the first carrying path P. Accordingly, the developer that has slid on the sliding plate 128 is divided into (i) the part carried in a direction indicated by an arrow G shown in FIG. 7 (the direction toward the first carrying member), which part corresponds to a position of the slit 117*a* and (ii) the other part carried in a direction indicated by an arrow F (the direction toward the second carrying member), which part does not corresponds to a position of the slit 117*a*.

Figure 8:
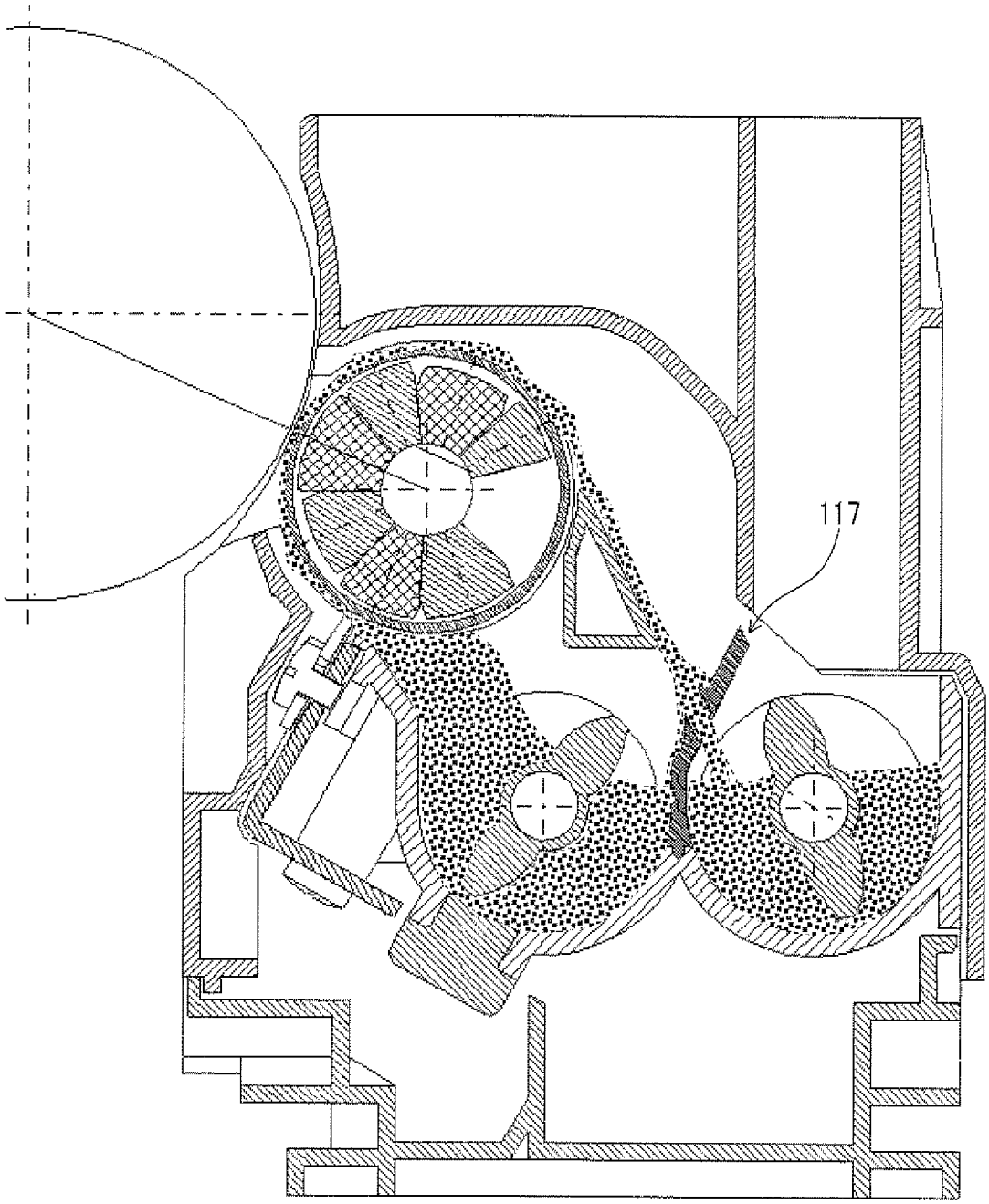
FIG. 8 is a view illustrating how the partition plate illustrated in FIG. 7 causes a developer to flow.

As described above, the partition plate 117 has the inclined plane 117*c* for carrying a part of the developer received from the sliding plate 128 to the second carrying path Q, and the inclined plane 117*c* has the slit (opening section) 117*a* that is a through-hole facing the first carrying path P. Therefore, as illustrated in FIG. 8, the developer received from the sliding plate 128 is divided into (i) the part which is carried to the second carrying path Q by the inclined plane 117*c*, and (ii) the other part which is carried to the first carrying path P via the slit 117*a*. That is, the developer is collected from the developing roller 114, and then is carried on the sliding plate 128, after that, a part of the developer does not pass through the slit 117*a* but collides against the inclined plane 117*c*, and is led to the second carrying path Q. Therefore, only the developer whose amount is limited by the slit 117*a* is collected into the first carrying path P. Here, the developing tank cover 115 has a toner supply opening 115*a* via which a toner is supplied into the first carrying path P.

Accordingly, it is possible to suppress, without being in proportion to an increase/reduction in driving speed of the developing device 2 during a high-speed driving operation or an adjustable-speed driving operation, a change (a change in amount, a change in speed) of the developer to be collected into the first carrying path P, which change has a big influence on a property of mixing a supplied toner and the developer with each other. This suppresses a change in height of the developer in the first carrying path P. It is therefore possible to (i) effectively mix the developer and the supplied toner with each other by the first carrying member 112, and (ii) prevent a reduction in stirring property even during the high-speed driving operation or the adjustable-speed driving operation. Accordingly, the developing device 2 can constantly carry out stable mixing of the supplied toner into the developer, and can reduce risks of scattering of the toner and generation of an image defect.

Further, since an amount of the developer to be collected into the first carrying path can be limited by use of only the inclined plane 117*c* of the partition plate, it is possible to (i) prevent the developing device from having a larger size and therefore (ii) suppress a production cost of the developing device.

Furthermore, as illustrated in FIG. 7, the slit 1 17*a* is formed on an imaginary extended plane of the inclined plane of the sliding plate 128. Therefore, as illustrated in FIG. 8, it is possible to efficiently supply, into the slit 117*a*, the developer carried by the sliding plate 128.

Figure 9:
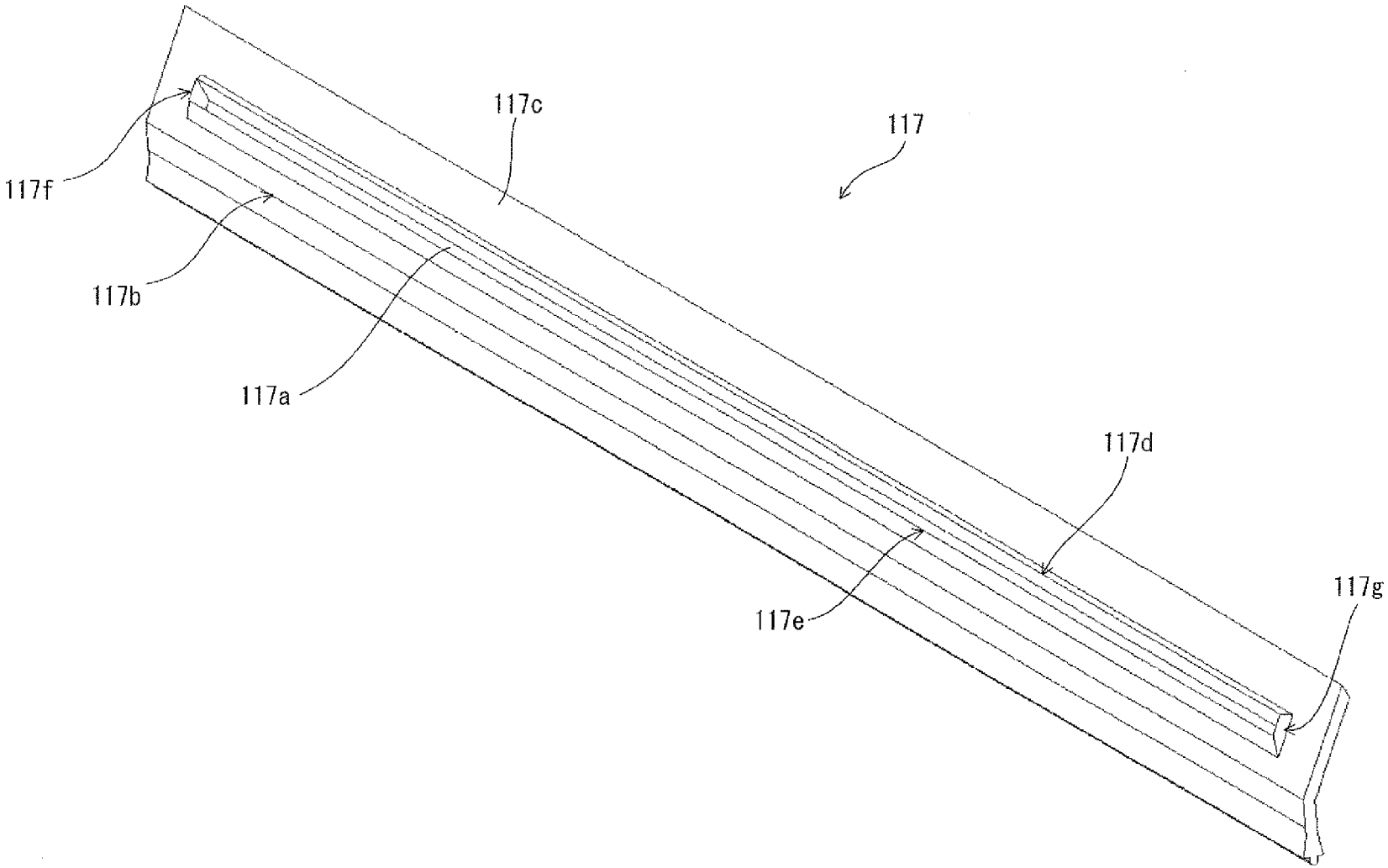
FIG. 9 is a perspective view illustrating details of a shape of the partition plate illustrated in FIG. 7.
Figure 10:
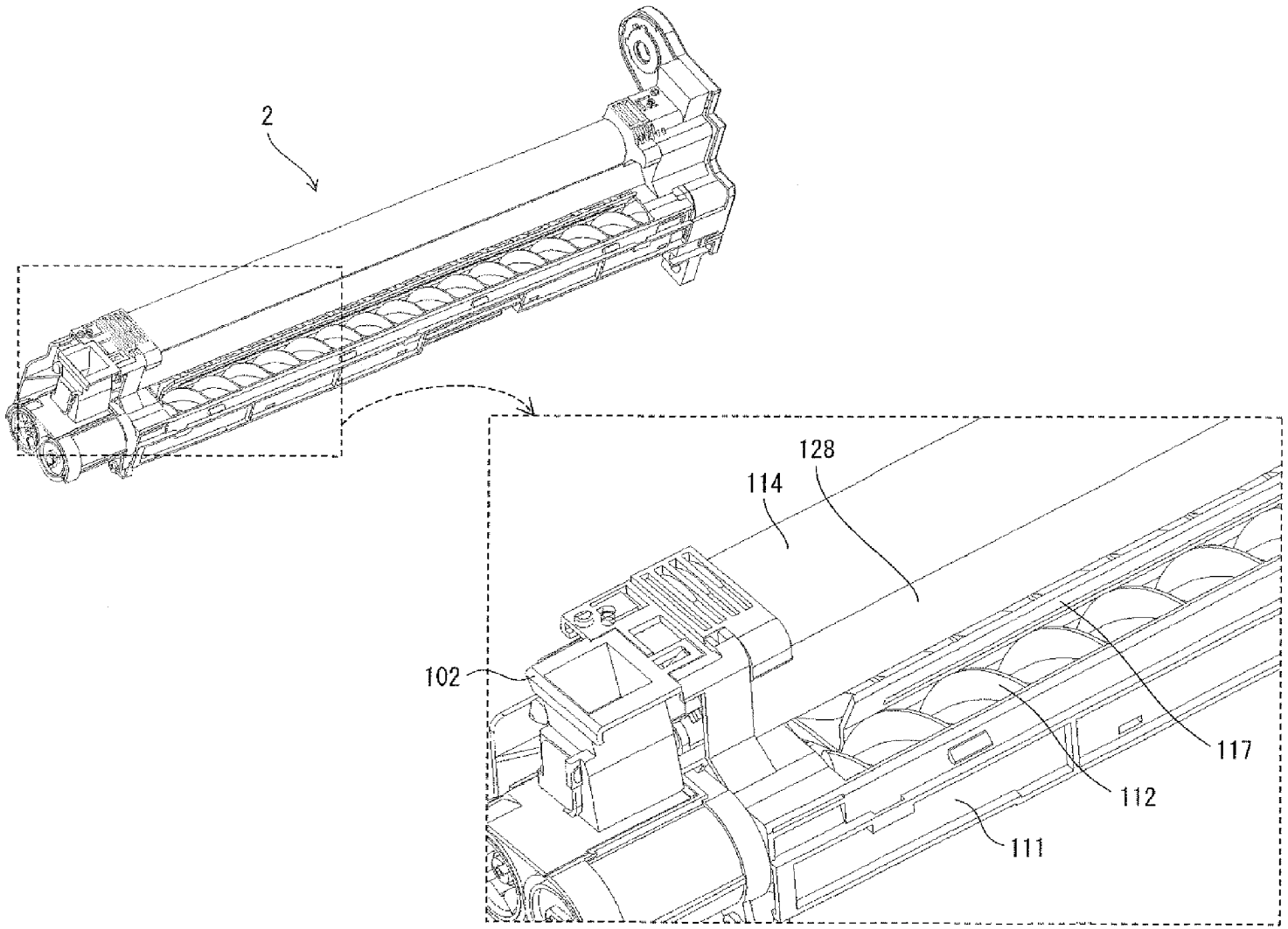
FIG. 10 is a perspective view three-dimensionally illustrating how the partition plate illustrated in FIG. 7 is attached to the developing device.

Moreover, as illustrated in FIGS. 9 and 10, the slit 117*a* is formed parallel to the longitudinal direction of the sliding plate 128. The slit 117*a* has a constant width and substantially the same length as that of the sliding plate 128. Therefore, regardless of which part of the sliding plate carries the developer (the developer slides on), it is possible to efficiently divide the developer into the part carried into the first carrying path P and the other part carried into the second carrying path Q.

Note that the longitudinal directions of the sliding plate 128, the partition plate 117, the developing roller 114, the first stirring member 112, and the second stirring member 113 are the same direction. Therefore, in other words, the slit 117*a* having a constant width is provided along the longitudinal direction of the partition plate 117.

Further, as illustrated in FIG. 9, ribs (projections) 117*d* through 117*g*, each having an acute-angled end, are provided on an outer edge (periphery) of the slit 117*a* of the inclined plane 117*c*, which outer edge is formed on the surface on which the developer is carried to the second carrying path Q. By providing, on the outer edge of the slit 117*a*, the ribs 117*d* through 117*g* each having the acute-angled end, it is possible for the part of the developer, which part is led to the first carrying path P via the slit 117*a*, to be less influenced by a flow of the other part of the developer, which other part is led to the second carrying path Q. Therefore, it becomes possible to stably supply the developer into the first carrying path P in a certain amount.

Note that the partition plate 117 is provided between the first carrying member 112 and the second carrying member 113, and is attached to the developing device 2 so as to partition an internal space of the developing tank 111 (see FIG. 10).

Here, in a case where the partition plate 117 is made from the same material as that of the sliding plate 128, it is possible to suppress, for a long term, a change in carrying power, which change is generated due to triboelectric charging between the partition plate 117 and the developer. For example, in a case where the partition plate 117 and the sliding plate 128 are made from, particularly, a resin containing a conductive carbon black, it is possible to suppress, for a long term, a change in carrying property of the developer.

Further, in a case where the partition plate 117 is made from a resin containing silica fine particles or glass fiber, it is possible to (i) suppress friction between the partition plate 117 and the developer by use of a hard silicon compound exposed on the surface of the partition plate 117, and (ii) maintain an effect of suppressing, for a long term, a change of the developer (an amount of the developer, a speed of the developer) to be collected into the first carrying path P.

<Arrangement of Present Invention>

A developing device of the present invention includes: a developer containing section for containing a developer including a toner and a carrier; a first carrying member for carrying the developer while stirring the developer, the first carrying member being provided in the developer containing section; a second carrying member for carrying the developer while stirring the developer, the second carrying member (i) being provided, in the developer containing section, in parallel with the first carrying member and (ii) carrying the developer in a direction opposite to a direction in which the first carrying member carries the developer; a partition member for partitioning an internal space of the developer containing section into (a) a first carrying path in which the developer is carried by the first carrying member and (b) a second carrying path in which the developer is carried by the second carrying member, the partition member being provided between the first carrying member and the second carrying member; a supply opening via which the toner is supplied into the first carrying path, the supply opening being formed as a part of a cover section of the developer containing section; and a developing roller for supplying the developer from the second carrying path to an image bearing member in a developing area which is an area facing the image bearing member, the developing roller supplying the developer in such a manner that the developing roller rotates while carrying the developer on a surface of the developing roller, the first carrying path and the second carrying path being connected to each other via spaces at both ends of the partition member, the developer being circulated through the first carrying path and the second carrying path, the developing device further including: a sliding member having an inclined plane for carrying a residual developer from the developing roller toward the first carrying path, which residual developer remains on the surface of the developing roller out of the developer provided on the surface of the developing member, the sliding member being provided downstream from the developing area in a rotational direction of the developing roller, the partition member having a carrying wall surface section for carrying a part of the residual developer received from the sliding member to the second carrying path, the carrying wall surface section being positioned downstream from the inclined plane of the sliding member, the carrying wall surface section having an opening section that is a through-hole facing the first carrying path.

According to the arrangement, it is possible to suppress, without being in proportion to an increase/decrease in driving speed of the developing device during a high-speed driving operation or an adjustable-speed driving operation, a change (a change in amount, a change in speed) of the part of the residual developer which is collected into the first carrying path, which change has a big influence on a property of mixing the supplied toner and the developer with each other. This suppresses a change in height of the developer in the first carrying path. Therefore, it is possible to (i) effectively mix the developer and the supplied toner with each other by the first carrying member, and (ii) prevent a reduction in stirring property even during the high-speed driving operation or the adjustable-speed driving operation. It is therefore possible to (a) constantly carry out stable mixing of the supplied toner and (b) reduce risks of scattering of the toner and generation of an image defect.

Further, since an amount of the developer to be collected into the first carrying path can be limited by use of only the carrying wall surface section of the partition member, it is possible to (i) prevent the developing device from having a larger size and therefore (ii) suppress a production cost of the developing device.

Further, in addition to the arrangement, the developing device of the present invention may be arranged such that the opening section is provided on an imaginary extended plane of the inclined plane of the sliding member.

According to the arrangement, the opening section is formed on the imaginary extended plane of the inclined plane of the sliding member, so that the developer carried by the sliding member can be efficiently carried into the opening section.

Furthermore, in addition to the arrangement, the developing device of the present invention may be arranged such that the carrying wall surface section is provided along a longitudinal direction of the partition member and has a length not less than that of the partition member in the longitudinal direction, and the opening section has a constant width along the longitudinal direction of the partition member.

According to the arrangement, the carrying wall surface section, which is formed along the longitudinal direction of the partition plate and has a length of not less than that of the partition plate, has the opening section that is formed along the longitudinal direction and has a constant width. Therefore, it is possible to effectively divide the developer into the part that is collected into the first carrying path and the other part that is collected into the second carrying path.

Moreover, in addition to the arrangement, the developing device of the present invention may be arranged such that the carrying wall surface section is provided so as to (i) face the inclined plane of the sliding member and (ii) have an angle of inclination which is identical with that of the inclined plane of the sliding member.

According to the arrangement, out of the developer received from the sliding member, the part of the developer, which is not to pass through the opening section but to be supplied to the second carrying path, can be prevented from remaining on the carrying wall surface section. Therefore, it is possible to suppress a significant change in balance in circulation of the developer on a carrying path from the carrying wall surface section to the second carrying path.

Further, in addition to the arrangement, the developing device of the present invention may be arranged such that the carrying wall surface section has, on its surface on which the part of the residual developer is carried to the second carrying path, a projection having an acute angle, which projection is provided around the opening section.

According to the arrangement, by providing, around the opening section, the projection having the acute-angled end, it is possible to cause the part of the developer which passes through the opening section to the first carrying path to be less likely to be influenced by a flow of the part of the developer which is led to the second carrying path. Therefore, it is possible to cause an amount of the developer supplied to the first carrying path to be stable.

Furthermore, in addition to the arrangement, the developing device of the present invention may be arranged such that the partition member is made from a material that is identical with that of the sliding member.

According to the arrangement, a material of the partition member is identical with that of the sliding member. Therefore, it is possible to suppress, for a long term, a change in carrying power, which change is generated due to triboelectric charging between the partition member and the developer.

For example, in a case where, in particular, the partition member is made from a resin containing conductive carbon black, which is a material identical with that of the sliding member, it is possible to suppress, for a long term, a change in carrying power.

Further, in addition to the arrangement, the developing device of the present invention may be arranged such that the partition member is made from a resin containing silica fine particles or fiberglass.

According to the arrangement, the partition member is made from the resin containing the silica fine particles or the fiberglass. Therefore, it is possible to (i) suppress, by a hard, silicon compound exposed on the surface of the partition member, abrasion of the partition member against the developer, and (ii) suppress, for a long term, a change (a change in amount, a change in speed) of the developer collected into the first carrying path.

In order to attain the object, an image forming apparatus of the present invention includes: an image bearing member on which an electrostatic latent image is formed; a charging device for charging a surface of the image bearing member; an exposure device for forming the electrostatic latent image on the surface of the image bearing member; a developing device for forming a toner image by supplying a toner to the electrostatic latent image; a transfer device for transferring the toner image formed on the surface of the image bearing member to a recording material; and a fixing device for fixing, on the recording material, the toner image transferred to the recording material, and the developing device is any one of developing devices described above.

According to the arrangement, the image forming apparatus of the present invention includes the developing device of the present invention. Therefore, it is possible to (i) carry out stable mixing of a supplied toner into a developer constantly, and (ii) reduce risks of scattering of the toner and generation of an image defect. Accordingly, the image forming apparatus of the present invention can stably form an image with high quality for a long term. Further, the image forming apparatus achieving such effects can be manufactured without an increase in cost.

The present invention is not limited to the description of the embodiments above, but may be altered by a skilled person within the scope of the claims. An embodiment based on a proper combination of technical means disclosed in different embodiments is encompassed in the technical scope of the present invention.

Industrial Applicability

The present invention is applicable to: a developing device for use in an electrophotographic image forming apparatus such as a printer, a copier, a facsimile, or an MFP (Multi Function Printer); and the electrophotographic image forming apparatus.

Reference Signs List

2: Developing device
3: Photoreceptor (image bearing member)
100: Image forming apparatus
111: Developing tank (developer container section)
112: First carrying member
113: Second carrying member
114: Developing roller
115: Developing tank cover (cover section)
115*a:* Toner supply opening
116: Doctor blade
117: Partition plate (partition member)
117*a:* Slit (opening section)
117*b:* Start point
117*c:* Inclined plane (carrying wall surface section)
117*d* through 117*g:* Rib (projection)
118: Permeability sensor
119: Developing sleeve
120: Magnet roller
121: Toner container
122: Toner discharge member
123: Toner discharge opening
124: Toner discharge member blocking wall
125: Toner-stirring member
126: Magnet fixing shaft
127: Developer releasing region
128: Sliding plate (sliding member)
134: Toner discharge member driving motor
P: First carrying path
Q: Second carrying path

The invention claimed is:

1. A developing device comprising:

a developer containing section for containing a developer including a toner and a carrier;

a first carrying member for carrying the developer while stirring the developer, the first carrying member being provided in the developer containing section;

a second carrying member for carrying the developer while stirring the developer, the second carrying member (i) being provided, in the developer containing section, in parallel with the first carrying member and (ii) carrying the developer in a direction opposite to a direction in which the first carrying member carries the developer;

a partition member for partitioning an internal space of the developer containing section into (a) a first carrying path in which the developer is carried by the first carrying member and (b) a second carrying path in which the developer is carried by the second carrying member, the partition member being provided between the first carrying member and the second carrying member;

a supply opening via which the toner is supplied into the first carrying path, the supply opening being formed as a part of a cover section of the developer containing section; and a developing roller for supplying the developer from the second carrying path to an image bearing member in a developing area which is an area facing the image bearing member, the developing roller supplying the developer in such a manner that the developing roller rotates while carrying the developer on a surface of the developing roller, the first carrying path and the second carrying path being connected to each other via spaces at both ends of the partition member, the developer being circulated through the first carrying path and the second carrying path, the developing device further comprising:

a sliding member having an inclined plane for carrying a residual developer from the developing roller toward the first carrying path, which residual developer remains on the surface of the developing roller out of the developer provided on the surface of the developing roller, the sliding member being provided downstream from the developing area in a rotational direction of the developing roller, the partition member having a carrying wall surface section for carrying a part of the residual developer received from the sliding member to the second carrying path, the carrying wall surface section being positioned downstream from the inclined plane of the sliding member, the carrying wall surface section having an opening section that is a through-hole facing the first carrying path, the opening section being provided on an imaginary extended plane of the sliding member.

2. The developing device as set forth in claim 1, wherein the carrying wall surface section is provided so as to (i) face the inclined plane of the sliding member and (ii) have an angle of inclination which is identical with that of the inclined plane of the sliding member.

3. The developing device as set forth in claim 1, wherein the carrying wall surface section has, on its surface on which the part of the residual developer is carried to the second carrying path, a projection having an acute angle, which projection is provided around the opening section.

4. An image forming apparatus comprising:

an image bearing member on which an electrostatic latent image is formed;

a charging device for charging a surface of the image bearing member;

an exposure device for forming the electrostatic latent image on the surface of the image bearing member;

a developing device for forming a toner image by supplying a toner to the electrostatic latent image;

a transfer device for transferring the toner image formed on the surface of the image bearing member to a recording material; and a fixing device for fixing, on the recording material, the toner image transferred to the recording material, the developing device being the developing device recited in claim 1.

5. A developing device comprising:

a developer containing section for containing a developer including a toner and a carrier;

a first carrying member for carrying the developer while stirring the developer, the first carrying member being provided in the developer containing section;

a second carrying member for carrying the developer while stirring the developer, the second carrying member (i) being provided, in the developer containing section, in parallel with the first carrying member and (ii) carrying the developer in a direction opposite to a direction in which the first carrying member carries the developer;

a partition member for partitioning an internal space of the developer containing section into (a) a first carrying path in which the developer is carried by the first carrying member and (b) a second carrying path in which the developer is carried by the second carrying member, the partition member being provided between the first carrying member and the second carrying member;

a supply opening via which the toner is supplied into the first carrying path, the supply opening being formed as a part of a cover section of the developer containing section; and a developing roller for supplying the developer from the second carrying path to an image bearing member in a developing area which is an area facing the image bearing member, the developing roller supplying the developer in such a manner that the developing roller rotates while carrying the developer on a surface of the developing roller, the first carrying path and the second carrying path being connected to each other via spaces at both ends of the partition member, the developer being circulated through the first carrying path and the second carrying path, the developing device further comprising:

a sliding member having an inclined plane for carrying a residual developer from the developing roller toward the first carrying path, which residual developer remains on the surface of the developing roller out of the developer provided on the surface of the developing roller, the sliding member being provided downstream from the developing area in a rotational direction of the developing roller, the partition member having a carrying wall surface section for carrying a part of the residual developer received from the sliding member to the second carrying path, the carrying wall surface section being positioned downstream from the inclined plane of the sliding member, the carrying wall surface section having an opening section that is a through-hole facing the first carrying path, the carrying wall surface section being provided so as to (i) face the inclined plane of the sliding member and (ii) have an angle of inclination which is identical with that of the inclined plane of the sliding member.

6. An image forming apparatus comprising:

an image bearing member on which an electrostatic latent image is formed;

a charging device for charging a surface of the image bearing member;

an exposure device for forming the electrostatic latent image on the surface of the image bearing member;

a developing device for forming a toner image by supplying a toner to the electrostatic latent image;

a transfer device for transferring the toner image formed on the surface of the image bearing member to a recording material; and a fixing device for fixing, on the recording material, the toner image transferred to the recording material, the developing device being the developing device recited in claim 5.

7. The developing device as set forth in claim 5, wherein the carrying wall surface section has, on its surface on which the part of the residual developer is carried to the second carrying path, a projection having an acute angle, which projection is provided around the opening section.

8. A developing device comprising:

a developer containing section for containing a developer including a toner and a carrier;

a first carrying member for carrying the developer while stirring the developer, the first carrying member being provided in the developer containing section;

a second carrying member for carrying the developer while stirring the developer, the second carrying member (i) being provided, in the developer containing section, in parallel with the first carrying member and (ii) carrying the developer in a direction opposite to a direction in which the first carrying member carries the developer;

a partition member for partitioning an internal space of the developer containing section into (a) a first carrying path in which the developer is carried by the first carrying member and (b) a second carrying path in which the developer is carried by the second carrying member, the partition member being provided between the first carrying member and the second carrying member;

a supply opening via which the toner is supplied into the first carrying path, the supply opening being formed as a part of a cover section of the developer containing section; and a developing roller for supplying the developer from the second carrying path to an image bearing member in a developing area which is an area facing the image bearing member, the developing roller supplying the developer in such a manner that the developing roller rotates while carrying the developer on a surface of the developing roller, the first carrying path and the second carrying path being connected to each other via spaces at both ends of the partition member, the developer being circulated through the first carrying path and the second carrying path, the developing device further comprising:

a sliding member having an inclined plane for carrying a residual developer from the developing roller toward the first carrying path, which residual developer remains on the surface of the developing roller out of the developer provided on the surface of the developing roller, the sliding member being provided downstream from the developing area in a rotational direction of the developing roller, the partition member having a carrying wall surface section for carrying a part of the residual developer received from the sliding member to the second carrying path, the carrying wall surface section being positioned downstream from the inclined plane of the sliding member, the carrying wall surface section having an opening section that is a through-hole facing the first carrying path, the carrying wall surface section having, on its surface on which the part of the residual developer is carried to the second carrying path, a projection having an acute angle, which projection is provided around the opening section.

9. An image forming apparatus comprising:

an image bearing member on which an electrostatic latent image is formed;

a charging device for charging a surface of the image bearing member;

an exposure device for forming the electrostatic latent image on the surface of the image bearing member;

a developing device for forming a toner image by supplying a toner to the electrostatic latent image;

a transfer device for transferring the toner image formed on the surface of the image bearing member to a recording material; and a fixing device for fixing, on the recording material, the toner image transferred to the recording material, the developing device being the developing device recited in claim 8.

* * * * *